United States Patent [19]

Wisbey

[11] 4,206,385

[45] Jun. 3, 1980

[54] BALLAST DE-ENERGIZING CIRCUIT FOR HIGH PRESSURE METAL VAPOR LAMP SYSTEM

[75] Inventor: Robert W. Wisbey, Arlington Heights, Ill.

[73] Assignee: Advance Transformer Company, Chicago, Ill.

[21] Appl. No.: 929,775

[22] Filed: Jul. 31, 1978

[51] Int. Cl.[2] ..... H05B 41/16; H05B 37/03

[52] U.S. Cl. ..... 315/119; 315/360; 361/94

[58] Field of Search ..... 315/106, 107, 119, 120, 315/291, 307, 360, 362, DIG. 5; 361/94

[56] References Cited

U.S. PATENT DOCUMENTS 2,309,711 2/1943 Pearson ..... 315/DIG. 5

2,760,117 8/1956 Van Ryan ..... 315/360 X

FOREIGN PATENT DOCUMENTS 2252310 5/1974 Fed. Rep. of Germany ..... 315/119

*Primary Examiner*—Eugene R. LaRoche

*Attorney, Agent, or Firm*—Silverman, Cass & Singer

[57] ABSTRACT

A circuit for protecting a ballast in a high pressure metal vapor, such as sodium, lamp system which includes means for interrupting the power supply to the ballast in the event that no current is flowing through the lamp, once the system has been energized. The circuit has automatic compensation for short interruptions and for the time which it normally requires for the lamp to ignite. The absence of current flow through the lamp is sensed and this information used to provide the protection.

6 Claims, 1 Drawing Figure

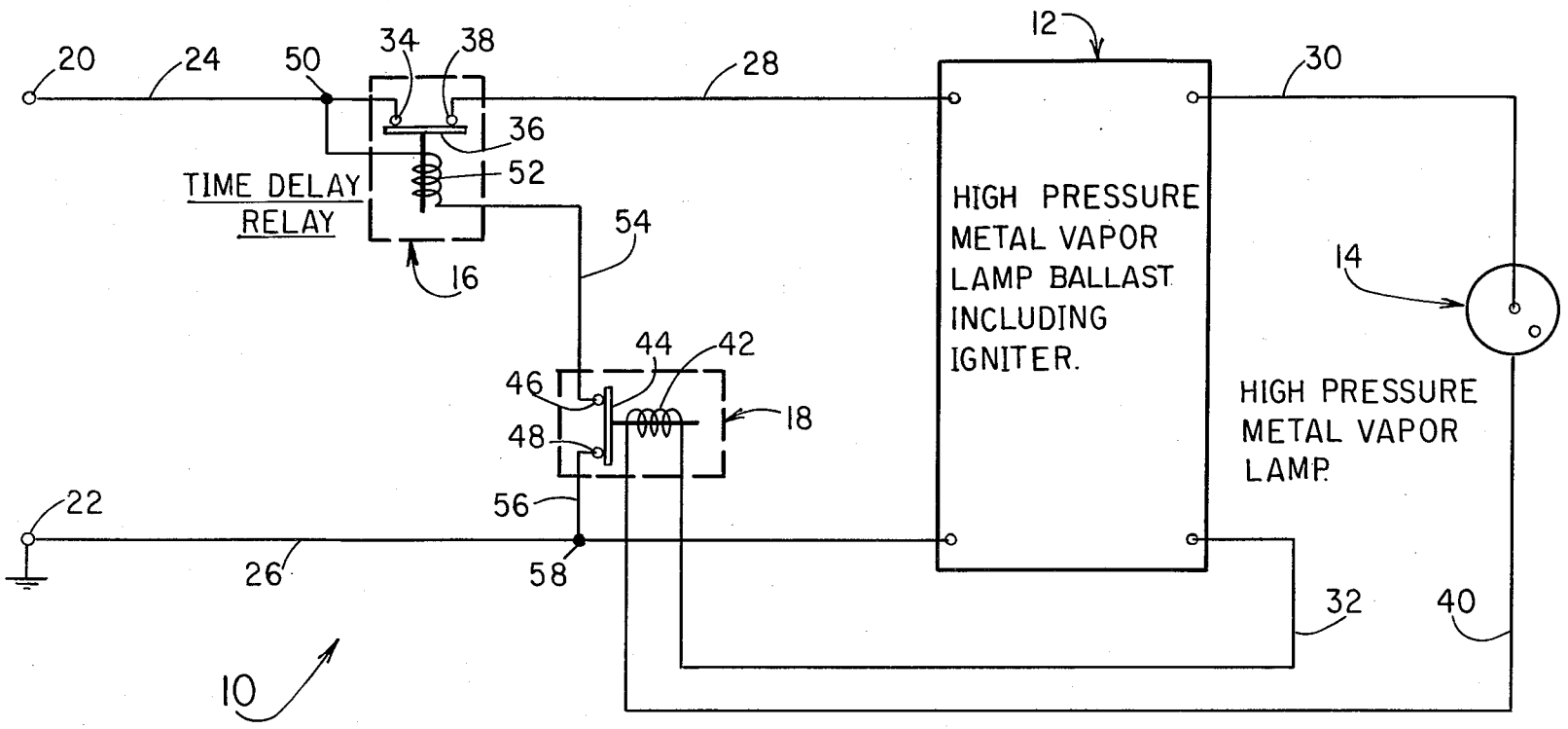
HIGH PRESSURE METAL VAPOR LAMP BALLAST INCLUDING IGNITER.
HIGH PRESSURE METAL VAPOR LAMP.
TIME DELAY RELAY
10
12
14
16
18
20
22
24
26
28
30
32
34
36
38
40
42
44
46
48
50
52
54
56
58

BALLAST DE-ENERGIZING CIRCUIT FOR HIGH PRESSURE METAL VAPOR LAMP SYSTEM

FIELD AND BACKGROUND OF THE INVENTION

This invention relates generally to high pressure metal vapor, such as sodium, lamp systems and more particularly is concerned with a circuit in which means are provided for interrupting power to the ballast of the system if the system should be energized while there is no lamp connected therein or if the high pressure metal vapor lamp is or becomes inoperative. Although not limited thereto, the invention will be described as applied to sodium vapor lamps.

The conventional high pressure sodium vapor (hereinafter HPSV) lamp system comprises a ballast whose input is connected to a relatively low voltage source of a.c. power and whose output has the HPSV lamp connected therein. The usual line furnished by the power company is at 120 volts. The ballast is required to perform several functions which comprise stepping up the line voltage to a voltage which will keep the HPSV lamp ignited; limiting the electric current which flows through the lamp once it has ignited; and furnishing the high voltage in the form of pulses required to ignite the lamp in the first place.

A metal vapor lamp is a gaseous discharge device and hence it requires a voltage much higher than its operating voltage to ignite it. In the case of the HPSV lamp this voltage is much greater than the operating voltage and may be as much as fifty times that voltage. This type of ballast typically includes a pulsing circuit which repeatedly applies high voltage pulses to the lamp until the lamp ignites and the flow of current causes the pulsing to stop. There are many variations of these pulsing circuits, and they are not intended to be continually energized; hence the components thereof are not built to carry high currents or to be subjected to the stress of continuous high voltage pulsing. These pulsing circuits are represented in the prior art by such patents as Attewell U.S. Pat. No. 3,407,334; Nuckolls U.S. Pat. No. 3,917,976; Nuckolls U.S. Pat. No. 3,963,958; and many others in related classes.

As in the case of all gaseous discharge lamps, since the lamp is a negative resistance device, as soon as ignited the lamp impedance drops drastically since ignition actually comprises ionization of the gas within the lamp envelope. The ballast of the system provides impedance as soon as current flows to limit the current, as for example, by utilization of a high leakage reactance transformer as one of the components. Ballasts for relatively low voltage lamps, such as for example fluorescent types, normally have no special pulsing circuits for ignition since the ratio of igniting to operating voltage is usually of the order of two to one.

In the case of the HPSV lamp system, when electrical power is applied to the input circuit of the ballast, the pulsing section commences to operate. High voltage pulses are applied to the HPSV lamp and in a few seconds when the lamp is cold, the lamp ignites and operating current flows through the ballast. By suitable self-operating switching means, the pulsing section of the ballast ceases operating and the current then flows through the portions of the ballast which are designed to carry this current normally.

In the event that electrical power is interrupted momentarily and then reapplied to the ballast input, as for example by a line failure or switching disconnection, the pulsing device again commences to operate to attempt to re-ignite the lamp. If the lamp is hot as is usual with HPSV lamps, the lamp will typically re-ignite in about a minute.

Normal use of a ballast in an HPSV lamp system will ensure ballast life of several years for a good quality product. The cost of HPSV ballasts which include the pulsing circuits described is substantially higher than the relatively simple ballasts of the type used for fluorescent lamp systems. Accordingly, any conditions which tend to decrease the life of a ballast for an HPSV lamp system must be avoided for economy as well as safety.

The principal problem with these systems is that the failureof the HPSV lamp to ignite for any reason keeps the pulsing circuit operating. The pulsing circuit or igniter, as it is often called, is not built for this type of continuous operation. Thus, since it is sold with the ballast, failure of the igniter results in loss of the entire ballast. This is true notwithstanding the fact that there is no failure of any other part of the ballast since there is no current flowing therein. As a matter of fact, the failure of fluorescent lamps in a typical system has no effect on most of the types of ballasts used therewith. An HPSV lamp ballast connected to a lamp that is not ignited or capable of being ignited cannot be expected to last for more than a couple of months.

Manufacturers of HPSV lighting equipment have attempted to obviate the loss of ballasts by educating their users to replace the HPSV lamps as soon as any failure is noted. In many instances, however, the physical location of the lamps or the expense of labor for replacement may result in delay which can be long enough to destroy the igniter or reduce its life materially. The ballast must be repaired or discarded when its igniter fails. It will remain inoperative until then.

According to the invention a circuit is proposed which includes means for sensing the flow of current through the HPSV lamp or the absence thereof to keep the ballast energized or to de-energize the same, respectively. By time delay means the normal time that is required for the HPSV lamp to ignite when hot is compensated for.

The following prior art is of interest:

Feinberg et al. U.S. Pat. No. 3,287,599;

Lee U.S. Pat. No. 3,721,832;

Rosen U.S. Pat. No. 3,890,545.

The Feinberg patent discloses a fault indicating circuit for a fluorescent lamp system which is equipped with an automatic resetting thermostat. Lee discloses a timing circuit for use with pumps, air conditioners and the like. Rosen describes a travelling wave tube protection circuit. None of these is believed to disclose the claimed invention herein.

SUMMARY OF THE INVENTION

A circuit for the protection of ballasts used in high pressure metal vapor lamp systems in which the ballast includes an igniter for applying high voltage pulses to the lamp during the ignition period.

A relay is connected in series with one input lead to the ballast, the relay contacts being normally closed and the relay solenoid being in series with a shunt conductor extending to the other input lead. A second relay is provided, its solenoid being in series with the output leads and lamp, but its contacts being in series with the shunt conductor. This relay is also in normally closed condition. A time delay period is built into the first relay so that although energized, the solenoid will not open the contacts until the time has elapsed. The time is chosen to be slightly greater than that which will be required for a hot lamp to be re-ignited.

When the system is energized and the lamp is cool, the igniter pulses the lamp and ignites it in a few seconds. During this period of time the contacts of the first relay remain closed and when current flows in the second solenoid because the lamp ignites, that solenoid pulls its armature off the contacts of the second relay, opening the shunt conductor and preventing opening of the contacts of the first relay.

If, however, the lamp does not ignite, or is extinguished, or is not in place, current does not flow through the second solenoid and the contacts of the second relay keep the shunt conductor closed. After a time delay the contacts of the first relay open, de-energizing the ballast, and remain open so long as the system is connected to the power source.

The time delay arrangement enables the circuit to ignore momentary interruptions of power which would extinguish and then quickly re-ignite the lamp.

The end result among others is protection of the igniter components of the ballast.

BRIEF DESCRIPTION OF THE DRAWING

The single FIGURE is a circuit diagram, partially in block form, showing the circuit of the invention applied to a high pressure sodium vapor lamp system.

DESCRIPTION OF THE PREFERRED EMBODIMENT

Looking now at the drawing, the reference character 10 designates a ballast and high pressure sodium vapor lamp (HPSV) system which comprises a ballast 12 and an HPSV lamp 14 connected in circuit together. The ballast and HPSV lamp system 10 is adapted to be energized from a suitable source of power such as a 120 volt 60 hertz line at the terminals 20 and 22 by means of the electrical leads 24 and 26 respectively extending to such terminals. One of the terminals is conventionally grounded.

The ballast 12 is of the type generally used for metal vapor lamps such as HPSV lamps. It is of conventional construction and generally will comprise a transformer having a primary winding and at least one secondary winding neither of which need be illustrated.

Conventional ballasts for high pressure metal vapor lamps normally require the inclusion of a so-called igniter or ignition circuit. This comprises some means to generate initial ignition voltage pulses which may be as much as ten to fifty times the operating voltage of the lamp. Thus an igniter is included in the ballast 12 which will automatically attempt to ignite the lamp 14 by means of high voltage pulses generated through switching components or the like when the ballast 12 is energized.

For purposes of explanation it will be understood that the leads 26 and 28 extend to the primary or input winding of the ballast 12 and leads 30 and 32 extend from the secondary or output winding. One side of the input circuit of the ballast 12 comprises terminal 20, lead 24, contact 34 of relay 16, which will be described hereinafter, armature 36, contact 38, and then extends by way of lead 28 to the input winding of the ballast 12. The other side of the input circuit comprises terminal 22 and then extends by way of lead 26 to the other terminal of the input winding of the ballast 12. The output circuit of the ballast 12 comprises lead 30 which extends from the one terminal of the ballast, usually connected with an output winding to the HPSV lamp 14, lead 40, the solenoid 42 of relay 18, which will be described hereinafter and leads 32 connected to the other terminal of the ballast, usually connected with a secondary winding.

Relay 18 comprises solenoid 42, armature 44 and contacts 46 and 48. It provides a normally closed circuit by means of the contacts and suitable biasing means associated with the armature.

Current flow through the HPSV lamp 14 included in the output circuit of ballast 12 energizes solenoid 42 which disengages armature 44 from contacts 46 and 48, thereby opening the circuit which includes these contacts. That circuit comprises junction 50 on lead 24, solenoid 52 of relay 16, lead 54, contact 46, armature 44, contact 48, lead 56 and junction 58 on lead 26. When the HPSV lamp 18 carries no current, as for example when it is extinguished, solenoid 42 is deenergized which causes armature 44 to engage contacts 46 and 48, thereby closing the described circuit.

Relay 16 comprises solenoid 52, armature 36 and contacts 34 and 38. The circuit including contacts 34 and 38 and armature 36 is normally closed, and is constructed in a known manner to provide a time delay so that only after a short period of time following the energising of the solenoid 52 will the normally closed circuit open. When this occurs, armature 36 disengages from contacts 34 and 38. Solenoid 52 is energized only when there is no current flowing through the HPSV lamp 14 in such a manner as to cause armature 44 to be pulled off its contacts against a mechanical bias by way of the action of relay 18 as described.

At the time that power is applied to the ballast and HPSV lamp system 10 at terminals 20 and 22, armature 36 of relay 16 is already engaged with contacts 34 and 38 closing the input circuit and permitting power to be applied to the input winding of ballast 12. At the same time, armature 44 of relay 18 is engaged with contacts 46 and 48 maintaining the circuit closed between junctions 50 and 58 and thereby energizing solenoid 52 which begins its time delay. The time delay of relay 16 is chosen to be longer than the longest period of time required by any HPSV lamp to be ignited or re-ignited by this circuit. This time delay keeps armature 36 engaged with contacts 34 and 38 and maintains power applied to the input winding of the ballast 12 through the input circuit long enough for HPSV lamp 14 to be ignited normally. During this normal period of time the igniter in the ballast 12 is operating to provide high voltage pulses to the lamp 14 to ignite it.

If ballast 12 and HPSV lamp 14 are in good operating condition, HPSV lamp 14 will ignite a short time after the power is applied to the ballast and HPSV lamp system 10 through operation of the igniter. When lamp 14 ignites, current will flow through the output circuit thereby energizing solenoid 42, disengaging armature 44 from contacts 46 and 48, opening the circuit between junctions 50 and 58, de-energizing solenoid 52, keeping armature 36 engaged with contacts 34 and 38, the input circuit closed, and power applied to the input winding of ballast 12.

With the lamp 14 ignited, the igniter within the ballast 12 ceases pulsing and no stress is placed on its components. Relays 16 and 18 are now stable, and no further changes will occur in them until either power is removed from the ballast and HPSV system 10 or the lamp 14 is extinguished. This normal condition has the relay 18 in open contact condition while the relay 16 is in closed contact condition.

If the ballast 12 or the lamp 14 is not in good operating condition, the HPSV lamp will not ignite after power is applied to the terminals 20 and 22 notwithstanding the attempts of the igniter to ignite the lamp and no electric current will flow through the output circuit. If the ballast 12 is defective it may heat up and cause problems through melting potting compound or even by heat transfer to nearby objects unless disconnected from the line. If the lamp 14 is defective but the ballast 12 is not defective, the igniter will attempt to start the lamp and repeat its pulsing. This will eventually destroy the igniter components and, even if the ballast is manually disconnected after a period of time before the igniter destroys itself, the life of the igniter—and hence the ballast itself will be shortened materially.

The circuit described includes the solenoid 42 which must be energized in order for the entire circuit 10 to be operating. If the ballast 12 or lamp 14 fails, the solenoid 42 will thus not be energized, armature 44 remains engaged with the contacts 46 and 48 and the circuit between the junctions 50 and 58 remains complete keeping the solenoid 52 energized.

After the time delay which has been built into the relay 16 has elapsed the armature 36 is pulled off the contacts 34 and 38 opening the input circuit and interrupting power to the input winding of the ballast 12. Relays 16 and 18 are now stable in what may be called a safety or emergency condition and no further changes will occur in them until power is removed from the ballast and HPSV lamp system 10 by opening the line leading to the terminals 20 and 22. This stable condition has relay 16 open and relay 18 closed. Current continues to flow through the solenoid 52 which is designed to carry the load. No damage can occur to the igniter or ballast if the lamp 14 is at fault nor can any dangerous conditions be produced in the ballast if it is at fault.

When power is removed from the ballast and HPSV lamp system 10 after the relays 16 and 18 have reached their stable safety or emergency conditions, as for example by disconnecting the power from the terminals 20 and 22, they return to their normal conditions, that is, both closed. The closing of the relay 16 may be suitably indicated to let the user know that something is amiss and he may correct the fault.

When power is momentarily removed from the ballast and HPSV lamp system 10 after HPSV lamp 14 is ignited which might occur during a momentary power failure, relays 16 and 18 are de-energized. When power is reapplied, the procedure described is once more carried out. This time, however the lamp 14 is hot, so the time delay must be longer than the longest time required to re-ignite the hot HPSV lamp 14. Operation of relays 16 and 18 then continues in the same manner as when power is applied to the system.

Variations are capable of being made without departing from the spirit or scope of the invention as defined in the appended claims.

What it is desired to secure by Letters Patent of the United States is:

1. In a ballast de-energizing circuit for a high-pressure metal vapor lamp system which is adapted to be connected to a relatively low voltage a.c. power source and in which there is a ballast with input leads and having an automatic igniter, the ballast adapted to have its input leads connected to the power source and its output leads connected to the lamp, the invention herein which comprises:

A. circuit interrupting means in one of the input leads of the ballast and actuating means for operating the circuit interrupting means to open the one lead and de-energize the ballast after a predetermined time delay longer than the ignition time of the lamp when hot, and B. sensing means associated with said lamp for sensing whether current flows through said lamp, said sensing means being coupled with said actuating means and serving to cause said actuating means to operate said circuit interrupting means to open said one lead when it senses that current is not flowing through said lamp but serving to prevent said actuating means from operating when current is flowing through said lamp.

2. The invention as claimed in claim 1 in which said sensing means comprise a first relay whose solenoid is in series with the output leads and lamp and an armature arranged to connect said a.c. power source to said actuating means.

3. The invention as claimed in claim 2 in which said actuating means comprise a solenoid of a second relay, the current interrupting means comprise the armature of said second relay and the armature of the first relay is in series with the solenoid of the second relay and together therewith connected in shunt across said input leads.

4. A ballast de-energizing circuit for high-pressure metal vapor lamp system which is adapted to be connected to a relatively low voltage source of a.c. power and which comprises:

A. a high-pressure metal vapor lamp ballast which has an internal self-operating igniter of the type which continuously produces high voltage igniting pulses until a lamp connected to the ballast ignites and thereafter ceases operating, said ballast having two input terminals and two output terminals, B. a high-pressure metal vapor lamp connected in a series loop with said output terminals, C. a first lead connected with one input terminal and adapted to be extended to one side of said a.c. power source and having first normally closed circuit interrupting means in series therewith, D. a second lead connected with the second input terminal and adapted to be extended to the second side of said a.c. power source, E. a shunt conductor extending from said second lead to the first lead on the side of said interrupting means away from the one input terminal, said shunt conductor having a time delay actuator and second normally closed circuit interrupting means in series therewith, the time delay actuator being arranged to operate the first normally closed circuit interrupting means when current flows through said actuator, but only after a predetermined time longer than the ignition time of the lamp when hot, F. a second actuator in the loop and in series with the lamp and arranged to operate the second normally closed circuit interrupting means when current flows through said actuator, whereby ignition of said lamp will cause current to flow through said second actuator to open the shunt conductor and prevent operation of said first actuator, but current interruption in the loop will close said shunt conductor and open the first circuit interrupting means to de-energize said ballast but only after the time delay.

5. The circuit as claimed in claim 4 in which the circuit interrupting means and its actuator comprise the armature and solenoid, respectively of a relay, there being two such relays.

6. The circuit as claimed in claim 4 in which the lamp is a high pressure sodium vapor lamp.

* * * * *